US010490026B2

(12) United States Patent
Bryant et al.

(10) Patent No.: US 10,490,026 B2
(45) Date of Patent: Nov. 26, 2019

(54) GAMING SYSTEM AND A METHOD OF GAMING

(71) Applicant: Aristocrat Technologies Australia Pty Limited, North Ryde, NSW (AU)

(72) Inventors: Natalie Bryant, Cherrybrook (AU); James Loader, Gosford (AU); Nichelle Nolan, Gosford (AU); Sam Walker, Marsfield (AU); Adeline Jie, Wantirna South (AU)

(73) Assignee: ARISTOCRAT TECHNOLOGIES AUSTRALIA PTY LIMITED, North Ryde, NSW (AU)

( * ) Notice: Subject to any disclaimer, the term of this patent is extended or adjusted under 35 U.S.C. 154(b) by 16 days.

(21) Appl. No.: 15/791,890

(22) Filed: Oct. 24, 2017

(65) Prior Publication Data

US 2018/0114407 A1 Apr. 26, 2018

(30) Foreign Application Priority Data

Oct. 24, 2016 (AU) ..... 2016904325

(51) Int. Cl.
*G07F 17/32* (2006.01)
*G07F 17/34* (2006.01)

(52) U.S. Cl.
CPC ..... *G07F 17/3262* (2013.01); *G07F 17/3213* (2013.01); *G07F 17/3225* (2013.01); *G07F 17/3246* (2013.01); *G07F 17/3251* (2013.01); *G07F 17/34* (2013.01)

(58) Field of Classification Search
None
See application file for complete search history.

(56) References Cited

U.S. PATENT DOCUMENTS

| | | | | |
|---|---|---|---|---|
| 5,833,538 | A | 11/1998 | Weiss | |
| 6,261,177 | B1 | 7/2001 | Bennett | |
| 6,991,539 | B2 | 1/2006 | Pacey | |
| 9,378,612 | B2 | 6/2016 | Ansari et al. | |
| 9,610,493 | B1 | 4/2017 | Wei et al. | |
| 9,666,019 | B1 | 5/2017 | Henrick et al. | |
| 9,731,201 | B1 | 8/2017 | Wei et al. | |
| 9,734,664 | B1 | 8/2017 | Hawk et al. | |
| 9,754,448 | B1 | 9/2017 | Dhaliwal | |
| 2006/0116194 | A1* | 6/2006 | Pacey | G07F 17/32 463/20 |

(Continued)

*Primary Examiner* — Jason T Yen
(74) *Attorney, Agent, or Firm* — Armstrong Teasdale LLP

(57) ABSTRACT

A gaming system includes a game implementer arranged to implement a base game, and an item collector arranged, during game play of a base game, by a player to add at least one item from a plurality of available items to an inventory associated with the player, wherein each collected item is usable by the player in the feature game. The system also includes a device arranged to store the item inventory of collected items usable by the player in the feature game. The system implements a feature game and includes an item selector arranged, during the feature game, to enable selection by the player of at least one item from the item inventory to use in the feature game, and an outcome evaluator arranged to determine an outcome of the feature game, based on the selected item. The feature game may be initiated by a player at any time.

17 Claims, 20 Drawing Sheets

(56) References Cited

U.S. PATENT DOCUMENTS

| | | | | |
|---|---|---|---|---|
| 2008/0113770 | A1* | 5/2008 | Gelber | G07F 17/3251 463/25 |
| 2009/0287707 | A1 | 11/2009 | Lyle et al. | |
| 2011/0111837 | A1* | 5/2011 | Gagner | G07F 17/3211 463/25 |
| 2012/0115593 | A1* | 5/2012 | Vann | G07F 17/3244 463/26 |
| 2015/0206397 | A1* | 7/2015 | Nelson | G07F 17/3267 463/42 |
| 2018/0082535 | A1* | 3/2018 | Filipour | G07F 17/3267 |

* cited by examiner

GAMING SYSTEM AND A METHOD OF GAMING

CROSS-REFERENCE TO RELATED APPLICATIONS

This application claims the benefit of priority to Australian Provisional Patent Application No. 2016904325, filed Oct. 24, 2016, the entire contents and disclosure of which are hereby incorporated by reference in their entirety.

BACKGROUND

The present invention relates to a gaming system and to a method of gaming.

It is known to provide a gaming system which includes a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device. While such gaming systems provide players with enjoyment, a need exists for alternative gaming systems in order to maintain or increase player enjoyment.

However, while such gaming systems provide users with enjoyment, a need exists for alternative gaming systems that facilitate greater interactivity with a player.

BRIEF DESCRIPTION

In accordance with a first aspect of the present invention, there is provided a gaming system comprising: a game implementer arranged to implement a base game; an item collector arranged during game play of a base game by a player to add at least one item from a plurality of available items to an item inventory associated with the player, each collected item usable by the player in a feature game; a storage device arranged to store the item inventory of collected items usable by the player in the feature game; the system arranged to implement a feature game and the system further comprising: an item selector arranged, during the feature game, to facilitate selection by the player of at least one item from the item inventory to use in the feature game; and an outcome evaluator arranged to determine an outcome of the feature game based on the selected item; wherein the feature game is initiated by a player at any time.

In one embodiment, the feature game is implemented according to an adventurer theme whereby an adventurer character attempts to perform at least one task using at least one collected item.

In one embodiment, the outcome evaluator is arranged to determine an outcome of the feature game based on a determination as to whether the task is successfully performed by the adventurer character using the selected item. The determination as to whether the task is successfully performed may be a random determination.

In one embodiment, a prize is awarded when the outcome is a successful outcome.

In one embodiment, the prize is a further item, and the gaming system is arranged to add the further item to the item inventory associated with the player. The prizes available may depend on the item selected.

In one embodiment, the probability of an outcome occurring depends on the item selected.

In one embodiment, the system is arranged to display an animation sequence representative of the adventurer character attempting to perform a task, the animation sequence selected based on whether the outcome evaluator has determined that the task is successfully performed by the adventurer.

In one embodiment, each feature game is associated with a sub-theme of the adventurer theme.

In one embodiment, the probability that the task is successfully performed is dependent on the suitability of the selected item for use in performing the task.

In one embodiment, the probability that the task is successfully performed increases with increasing suitability of the selected item for use in performing the task.

In one embodiment, the system is arranged to prevent play of a feature game if at least one selected item is unsuitable for use in performing the task.

In one embodiment, the system is arranged to allow play of a feature game only if the at least one item is stored in the item inventory.

In one embodiment, the system is arranged to allow play of a feature game only if at least one suitable item for use in performing the task is stored in the item inventory.

In one embodiment, the system is arranged to allow play of a feature game even if the at least one selected item is unsuitable for use in performing the task.

Each item may represent a tool.

In one embodiment, the system is arranged to display a map that includes a plurality of game identifiers, each game identifier representing a sub-theme of the adventurer theme, wherein selection of a game identifier displays at least one game icon respectively associated with the relevant at least one feature game. Selection of a game identifier may cause a scene representative of the location of the game identifier on the map to be displayed, the scene including a plurality of game icons associated with selectable feature games.

In one embodiment, the system is arranged to enable a player to select at least one item to be combined with at least one other item and to store a new item in the item inventory if the combination is associated with a predefined item.

In one embodiment, each item has an associated credit value and the system is arranged to enable a player to exchange a collected item for game credit.

In one embodiment, the system is arranged to compel a player to exchange a collected item for game credit prior to ceasing game play.

In one embodiment, the system is arranged to award credits to a player when the outcome evaluator determines a successful outcome of the feature game.

In one embodiment, the number of credits awarded to a player when the outcome evaluator determines a successful outcome of the feature game is based on the associated credit value of the at least one item selected to use in the feature game.

In one embodiment, the number of credits awarded to a player when the outcome evaluator determines a successful outcome of the feature game is equal to the associated credit value of the at least one item selected to use in the feature game.

In one embodiment, the number of credits awarded to a player when the outcome evaluator determines a successful outcome of the feature game is based on the suitability of the at least one selected item to use in the feature game.

In one embodiment, the number of credits awarded to a player when the outcome evaluator determines a successful outcome of the feature game increases with increasing suitability of the at least one selected item to use in the feature game.

In one embodiment, the system is arranged to add at least one item to the item inventory associated with the player when the outcome evaluator determines a successful outcome of the feature game.

In one embodiment, the item collector is arranged during game play of a base game by a player to add at least one item from the plurality of available items to the item inventory associated with the player each time a base game is played by the player.

In one embodiment, the item collector is arranged during game play of a base game by a player to add at least one item from the plurality of available items to the item inventory associated with the player in response to a trigger condition. The trigger condition may occur randomly, and may occur in response to display of one or more defined symbols during a base game.

In one embodiment, the item to be added to the item inventory may be selected randomly.

In one embodiment, the gaming system includes a plurality of symbol sets for use in the base game, the gaming system arranged to select one of the symbol sets for use in the base game.

In one embodiment, each symbol set is weighted towards at least one particular item.

In one embodiment, at least one item of the plurality of available items is dependent on defined criteria.

In one embodiment, the at least one item of the plurality of available items is dependent on time of year.

In one embodiment, the item inventory is retainable by a player for use in subsequent game play.

In one embodiment, at least one item in the item inventory is transferrable to another player.

In one embodiment, at least one transferrable item in the item inventory is transferrable to another player in return for a credit amount or another item.

In one embodiment, the system is arranged to receive credit amount bids for the at least one transferrable item from other players, and the at least one transferrable item is transferrable to another player based on the highest received bid.

In one embodiment, the system may be arranged to display a plurality of item portions and to display a plurality of item portions that are part of the same item when the item is selected for addition to the item inventory. The gaming system may comprise a plurality of reels, and each item portion may be displayed on a reel.

In one embodiment, the gaming system may be arranged to display an animated item when the plurality of displayed item portions are part of the same item and the item is selected for addition to the item inventory.

In one embodiment, the system may be arranged to enable a player to purchase tools, for example by enabling the player to select specific tools to be purchased, or by enabling the player to purchase tool packs that include a random selection of tools. The type and amount of tools included in such a tool pack may depend on the amount of credits spent by the player.

The gaming system may be implemented using a computing device, which may be a portable computing device such as a smartphone, as a stand-alone gaming machine or across a network.

In accordance with a second aspect of the present invention, there is provided a method of gaming comprising:

implementing a base game;

during game play of a base game by a player, adding at least one item from a plurality of available items to an item inventory associated with the player, each collected item usable by the player in a feature game;

implementing a feature game, wherein the feature game includes:

facilitating selection by the player of at least one item from the item inventory to use in a feature game; and determining an outcome of the feature game based on the selected item;

wherein the feature game is initiated by a player at any time.

In accordance with a third aspect of the present invention, there is provided a gaming system comprising:

a game implementer arranged to implement a base game;

an item collector arranged during game play to add at least one item from a plurality of available items to an item inventory associated with the player, each collected item usable by the player in a feature game;

a storage device arranged to store the item inventory of selected items usable by the player in the feature game;

the system arranged to implement a feature game and the system further comprising:

an item selector arranged, during the feature game, to facilitate selection by the player of at least one item from the item inventory to use in the feature game; and an outcome evaluator arranged to determine an outcome of the feature game based on the selected item.

In accordance with a fourth aspect of the present invention, there is provided a method of gaming comprising:

implementing a base game;

adding at least one item from a plurality of available items to an item inventory associated with the player during game play, each collected item usable by the player in a feature game;

storing the item inventory of selected items usable by the player in the feature game;

implementing a feature game;

during the feature game, facilitating selection by the player of at least one item from the item inventory to use in the feature game; and determining an outcome of the feature game based on the selected item.

In accordance with a fifth aspect of the present invention, there is provided a computer program arranged when loaded into a computer to instruct the computer to operate in accordance with a gaming system according to the first aspect of the present invention.

In accordance with a sixth aspect of the present invention, there is provided a computer readable medium having computer readable program code embodied therein for causing a computer to operate in accordance with a gaming system according to the first aspect of the present invention.

BRIEF DESCRIPTION OF DRAWINGS

The present invention will now be described, by way of example only, with reference to the accompanying drawings, in which.

DETAILED DESCRIPTION

Figure 1:
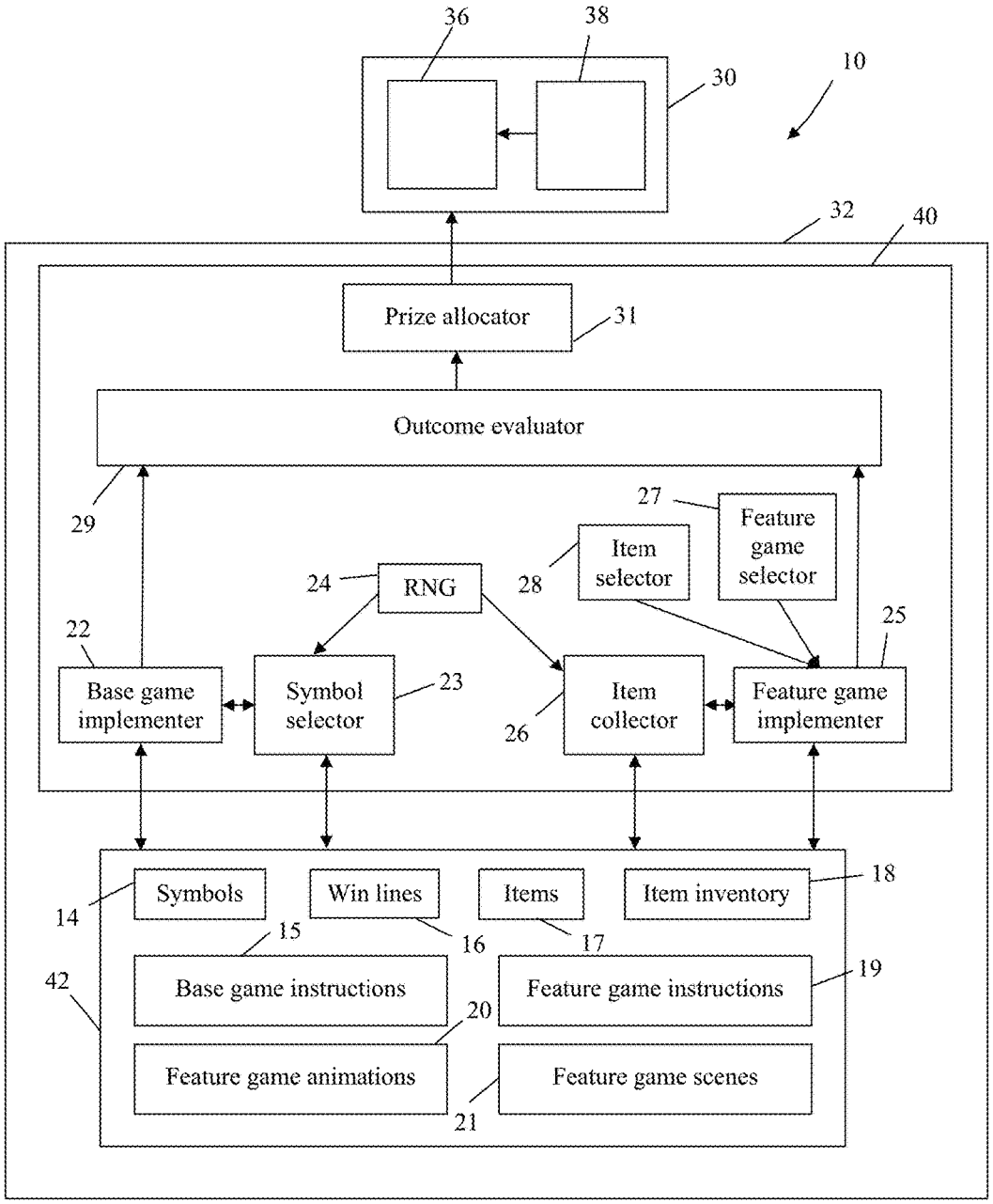
FIG. 1 is a schematic block diagram of exemplary functional components of a gaming system.

Referring to the drawings, there is shown a schematic block diagram of exemplary functional components of a gaming system 10 arranged to implement a probabilistic game. In the exemplary embodiment, the game is of the type wherein several symbols from a set of symbols are randomly displayed, and a game outcome is determined on the basis of the displayed symbols. With some of such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same win line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions. The available win lines may be fixed, may be determined on the basis of the bet placed, or may be selectable by a player.

The present gaming system operates such that, at least during a portion of a game implemented by the gaming system, a player is provided with the option of playing a feature game. During play of a base game by a player, items are collected and stored in an item inventory associated with the player, and the items in the item inventory are subsequently usable by the player during feature games. The feature game played by the player is selectable by the player from a plurality of feature games as part of an adventure theme, and an outcome of the feature game is determined by an outcome evaluator based on one or more collected items that have been selected for use by the player.

In one embodiment, the feature games are grouped in sub-themes, with each sub-theme incorporating an adventurer character faced with one or more tasks to complete using one or more items, for example tools. During play of a feature game, the player selects one or more appropriate items from the item inventory associated with the player to be used during the feature game. Outcomes for the feature game are then determined and, if appropriate, the player is awarded a prize, for example in the form of additional credits for use in play of base games, or additional tools for use in the feature games.

Referring to FIG. 1, a schematic diagram of exemplary operative components of a gaming system 10 is shown. The components comprise a player interface 30 and a game controller 32. The player interface 30 is arranged to enable interaction between a player and the gaming system and for this purpose includes input/output components required for the player to enter instructions and play the game. Components of the player interface 30 may vary but will typically include one or more displays 36 and a touch screen 38.

In the present example, the gaming system 10 is operable in normal game mode wherein a base game is implemented and special game mode wherein feature games are implemented. In this example, special game mode is arranged to commence when selected by a player.

The gaming system may be implemented in any suitable way, and in this example the gaming system 10 is implemented using a computing device. In this example, the computing device is a portable computing device, such as a smartphone. As an alternative, however, the gaming system may be implemented as an electronic gaming machine, for example of the type that is disposed at a gaming venue such as a casino. With an electronic gaming machine implementation, the gaming system 10 would typically include a credit mechanism to enable a player to input credits and receive payouts, and a physical game play mechanism arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42. It will be understood that in this specification the term "processor" is used to refer generically to any device that can process game play instructions and may include a microprocessor, microcontroller, programmable logic device or any computational device.

The memory 42 is arranged to store symbols data 14 indicative of a plurality of symbols for use during implementation of a base game, base game instruction data 15 usable by the gaming machine 10 to control operation of the base games, and win lines data 16 indicative of win lines usable for determination of winning outcomes.

The memory 42 is also arranged to store items data 17 indicative of items, in this embodiment tools, that are available for collection by a player during play of base games, an item inventory 18 that stores data indicative of items that have already been collected by the player, and feature game instruction data 19 usable by the gaming machine 10 to control operation of the feature games.

The memory 42 also includes data indicative of a feature game scene 21 that is displayed to a player when the player selects to play a feature game. In this example, the scene displayed to the player shows an adventurer character in the scene together with feature game icons at locations on the scene representative of the theme used in the feature game. For example, a feature game icon may be displayed adjacent a ravine, and the feature game associated with the feature game icon may have a theme wherein the adventurer character attempts to cross the ravine using one or more items stored in the item inventory 18.

The memory also includes feature game animations 20 that are activated when a player selects a feature game and selects one or more items from the item inventory 18 to use with the feature game. For example, for a feature game wherein an adventurer character attempts to cross a ravine using one or more items stored in the item inventory 18, a game animation 20 showing the character attempt to cross the ravine with the item(s) may be displayed.

The game controller 32 includes a base game implementer 22 arranged to implement a base game, in this example using a symbol selector 23 which is arranged to select several symbols from the stored symbols 14 for display to a player. In this example, the selection carried out by the symbol selector 23 is made using a random number generator 24. During a base game, an item collector 26 is arranged to control collection of items by a player and store data indicative of the collected items in the item inventory 18. The item collector 26 may be arranged to control collection of items using the random number generator 24.

It will be appreciated that the random number generator 24 may be of a type which is arranged to generate random numbers based on a seed number, and that in this specification the term "random" will be understood accordingly.

The game controller 32 also includes a feature game selector 27 usable by a player to instigate implementation of a feature game, and an item selector 28 arranged to facilitate selection by a player of one or more items to be used in the feature game.

The game controller 32 also includes an outcome evaluator 29 which in accordance with the base and feature game instructions 15, 19 determines game outcomes, and a prize allocator 31 arranged to allocate prizes for winning outcomes.

In the present embodiment, the base game implementer 22, the symbol selector 23, the feature game implementer 25, the feature game selector 27, the item selector 28, the outcome evaluator 29 and the prize allocator 31 are at least partly implemented using the processor 40 and associated software and memory, although it will be understood that other implementations are envisaged.

The gaming system 10 can take a number of different forms.

Figure 2:
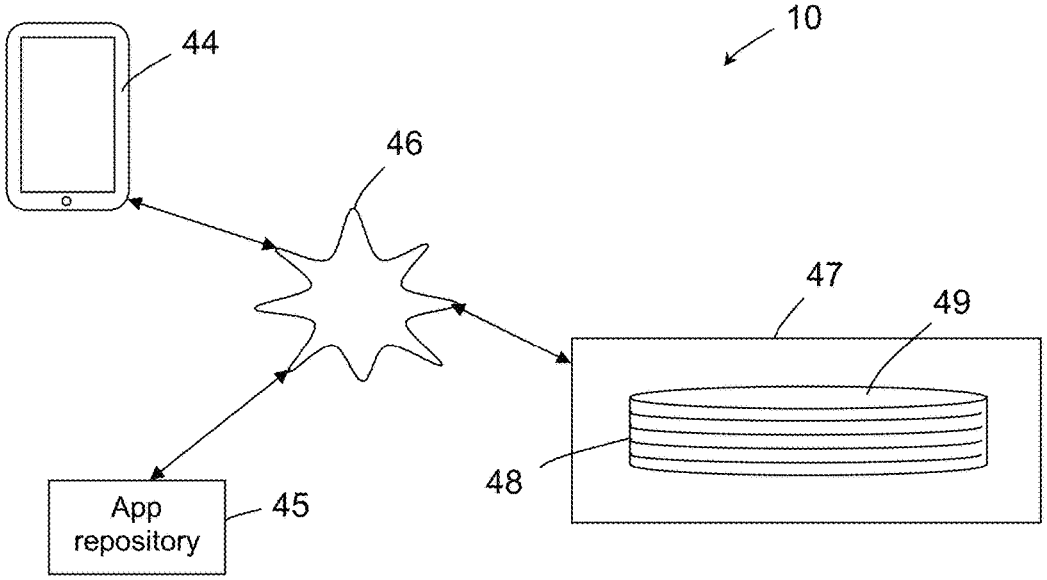
FIG. 2 is a diagrammatic representation of an exemplary gaming system including the gaming system shown in FIG. 1 and implemented using a portable computing device.

In a first form, as shown in FIG. 2, the gaming system is implemented using a portable computing device such as a smartphone 44 arranged to implement a game control application that is downloaded from an application repository 45 through a wide area network such as the Internet 46.

In this example, the application implemented by the smartphone 44 communicates with a server 47 through the Internet 46, for example in order to facilitate storage of game events, game status, awards and so on in a player record 48 at a common accessible storage device 49.

Figure 3:
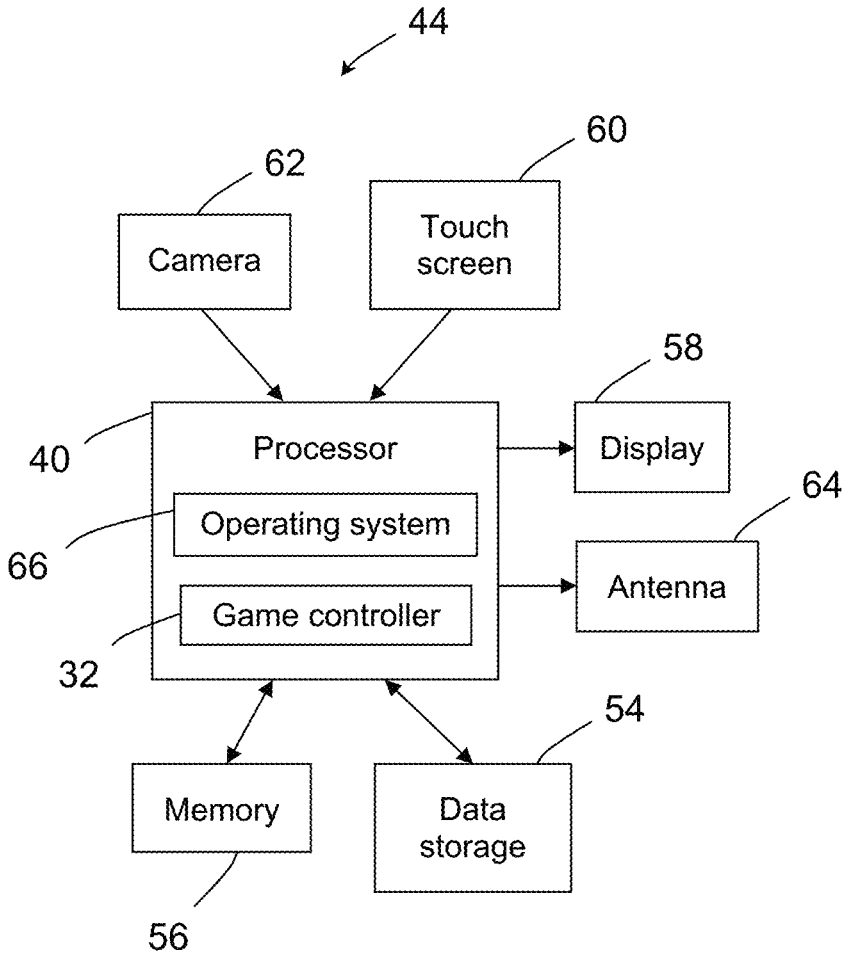
FIG. 3 is a schematic block diagram of exemplary operative components that may be used with the portable computing device shown in FIG. 2.

Exemplary functional components of the smartphone 44 are shown in FIG. 3.

The functional components include the processor 40 that controls and coordinates operations in the smartphone 44, and in particular implements applications stored in a data storage device 54 using memory 56.

The functional components also include a display 58 and touch screen 60 that overlies the display 58, a camera 62, and one or more antennae 64.

In this example, the processor 40 implements an operating system 66 and also implements the game controller 32 shown functionally in FIG. 2 by implementing a game controller application that has been downloaded from the online application repository 45.

Figure 4:
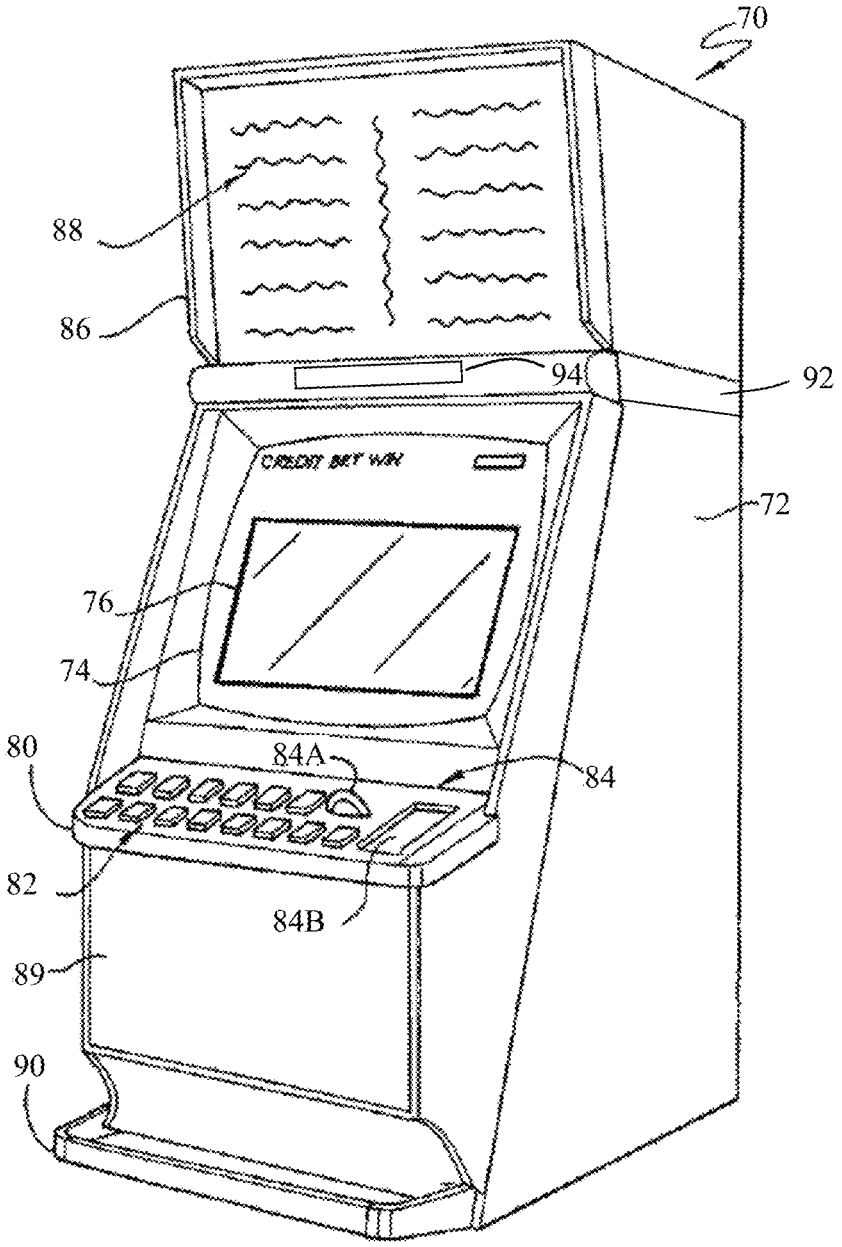
FIG. 4 is a diagrammatic representation of an alternative gaming system including the gaming system shown in FIG. 1 and implemented in the form of a stand-alone gaming machine.
Figure 5:
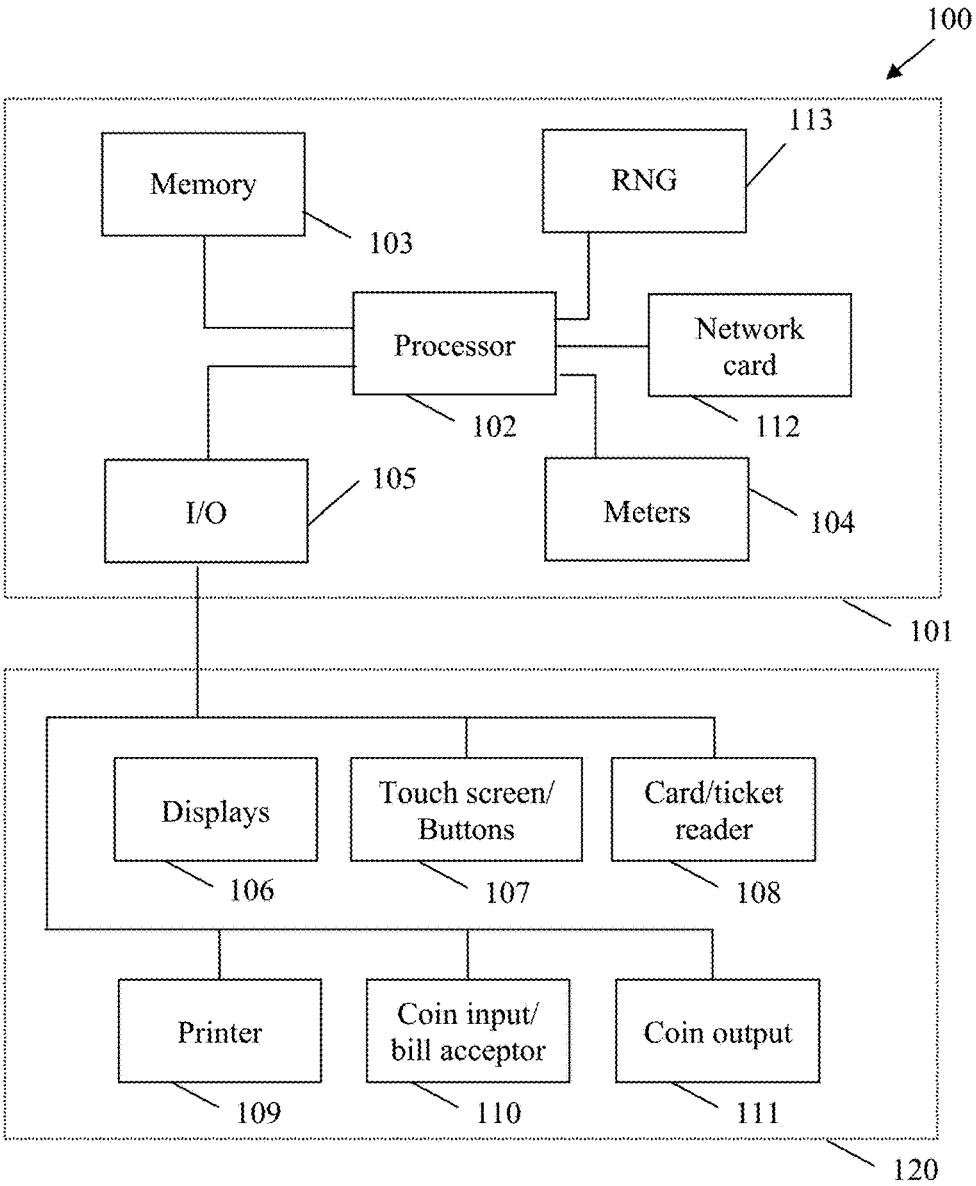
FIG. 5 is a schematic block diagram of exemplary operative components that may be used with the gaming machine shown in FIG. 4.
Figure 6:
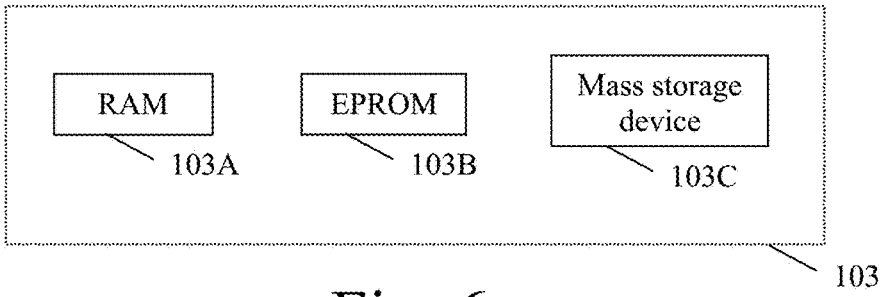
FIG. 6 is a schematic block diagram of exemplary components of a memory that may be used with the gaming machines shown in FIGS. 2 and 4.

In a second form, as shown in FIGS. 4 to 6, a stand-alone gaming machine is provided wherein all or most components required for implementing the game are present in a player operable gaming machine.

Figure 7:
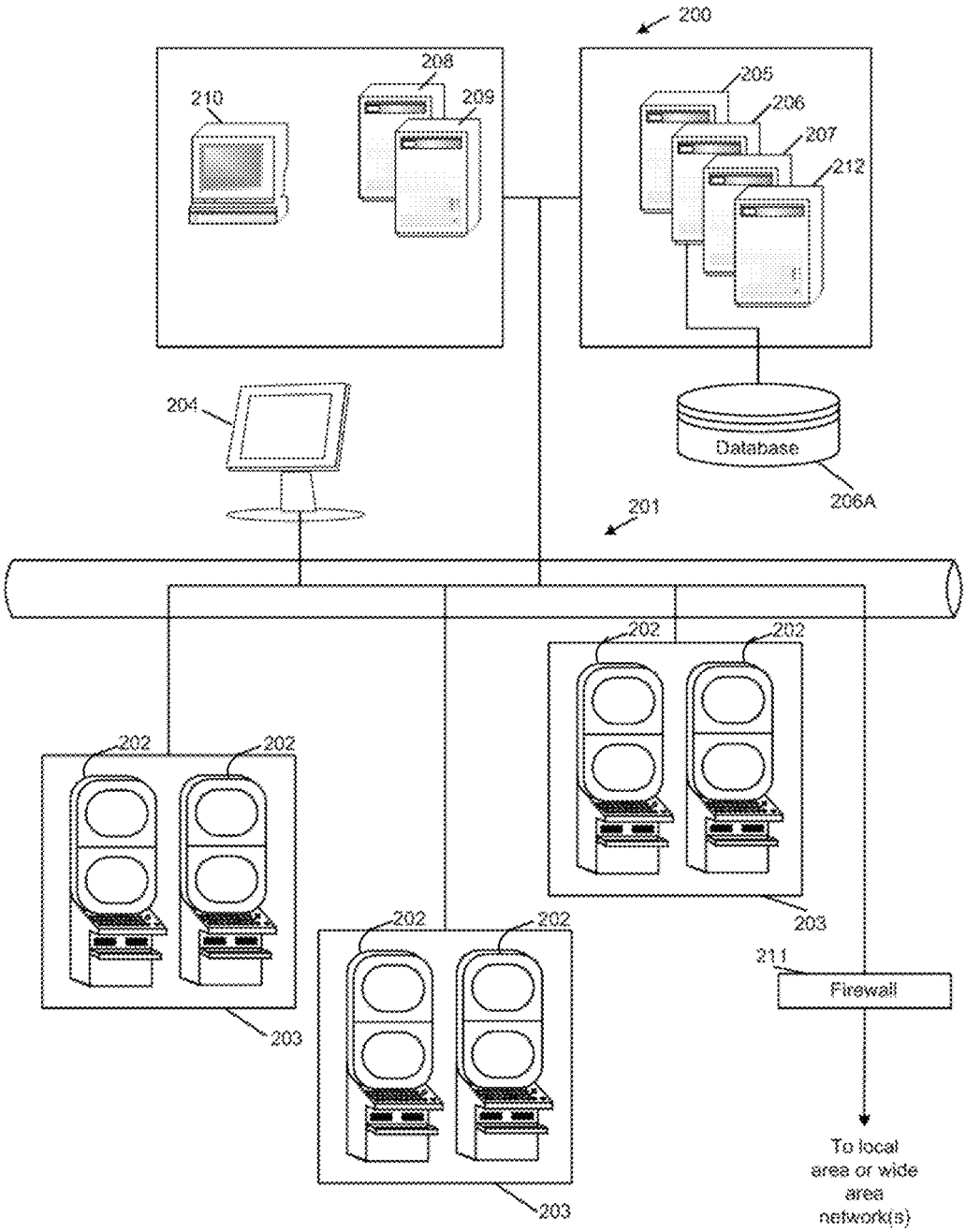
FIG. 7 is a schematic diagram of a further alternative gaming system including the gaming system shown in FIG. 1 and implemented over a network.

In a third form, as shown in FIG. 7, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to play audible and/or display visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand-alone gaming machine mode, "thick client" mode or "thin client" mode depending on the game being played, operating conditions, and so on. Other variations will be apparent to persons skilled in the art.

A gaming system in the form of a stand-alone gaming machine 50 is illustrated in FIG. 4. The gaming machine 70 includes a console 72 having a display 74 on which is displayed representations of a game 76 that can be played by a player. A mid-trim 80 of the gaming machine 70 houses a bank of buttons 82 for enabling a player to interact with the gaming machine, in particular during gameplay. The mid-trim 80 also houses a credit input mechanism 84 which in this example includes a coin input chute 84A and a bill collector 84B. Other credit input mechanisms may also be employed, for example, a card reader for reading a smart card, debit card or credit card.

A top box 86 may carry artwork 88, including for example pay tables and details of bonus awards and other information or images relating to the game. Further artwork and/or information may be provided on a front panel 89 of the console 72. A coin tray 90 is mounted beneath the front panel 89 for dispensing cash payouts from the gaming machine 70.

The display 74 is in the form of a video display unit, particularly a cathode ray tube screen device. Alternatively, the display 74 may be a liquid crystal display, plasma screen, or any other suitable video display unit. The top box 76 may also include a display, for example a video display unit, which may be of the same type as the display 74, or of a different type.

The display 74 in this example is arranged to display representations of several reels, each reel of which has several associated symbols. Typically 3, 4 or 5 reels are provided. During operation of the game, the reels first appear to rotate then stop with typically three symbols visible on each reel.

A player marketing module (PMM) 92 having a display 4 is connected to the gaming machine 70. The main purpose of the PMM 92 is to allow the player to interact with a player loyalty system. The PMM has a magnetic card reader for the purpose of reading a player tracking device, for example as part of a loyalty program. However other reading devices may be employed and the player tracking device may be in the form of a card, flash drive or any other portable storage medium capable of being read by the reading device. In this example, the PMM 92 is a Sentinel III device produced by Aristocrat Technologies Pty Ltd.

FIG. 5 shows a block diagram of exemplary operative components of a typical gaming machine 100 which may be the same as or different to the gaming machine shown in FIG. 4.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

FIG. 6 shows a block diagram of exemplary main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 5, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106,107,108,109,110,111 may be provided remotely from the game controller 101.

FIG. 7 shows an exemplary gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 4 and 5, or may have simplified functionality depending on the requirements for implementing game play. While banks 203 of two gaming machines are illustrated in FIG. 7, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

Examples of specific implementations of the gaming system will now be described with reference to screen representations shown in FIGS. 8 to 19 and flow diagrams 340, 360, 380, 400 and 420 shown in FIGS. 20 to 24 which illustrate steps 342 to 428 of a method of gaming implemented by the gaming system.

In one embodiment, the gaming system operates in normal game mode wherein a base game is implemented and, when selected by a player, in special game mode wherein a feature game is implemented.

In the present embodiment, the base game is of a type including multiple rotatable reels, which may be physical reels or virtual reels, with each reel having a plurality of symbols and optionally one or more function symbols. Win outcomes are determined on the basis of the symbols visible when the reels stop rotating, and in this example three symbols are displayed on each reel at any time. A win outcome may occur based on display of the same symbol along normal win lines which may extend horizontally, diagonally, or in any other predefined continuous line. A win outcome may also occur based on display of multiple scattered symbols at any display location. A win outcome may also occur on the basis of one or more standard symbols in combination with at least one function symbol having an assigned function. For example a function symbol may correspond to a wild function, a scatter function, a multiply function, a repeat win function, and so on.

During a base game, win outcomes are determined on the basis of the symbols displayed on the reels after the reels have stopped rotating.

Figure 8:
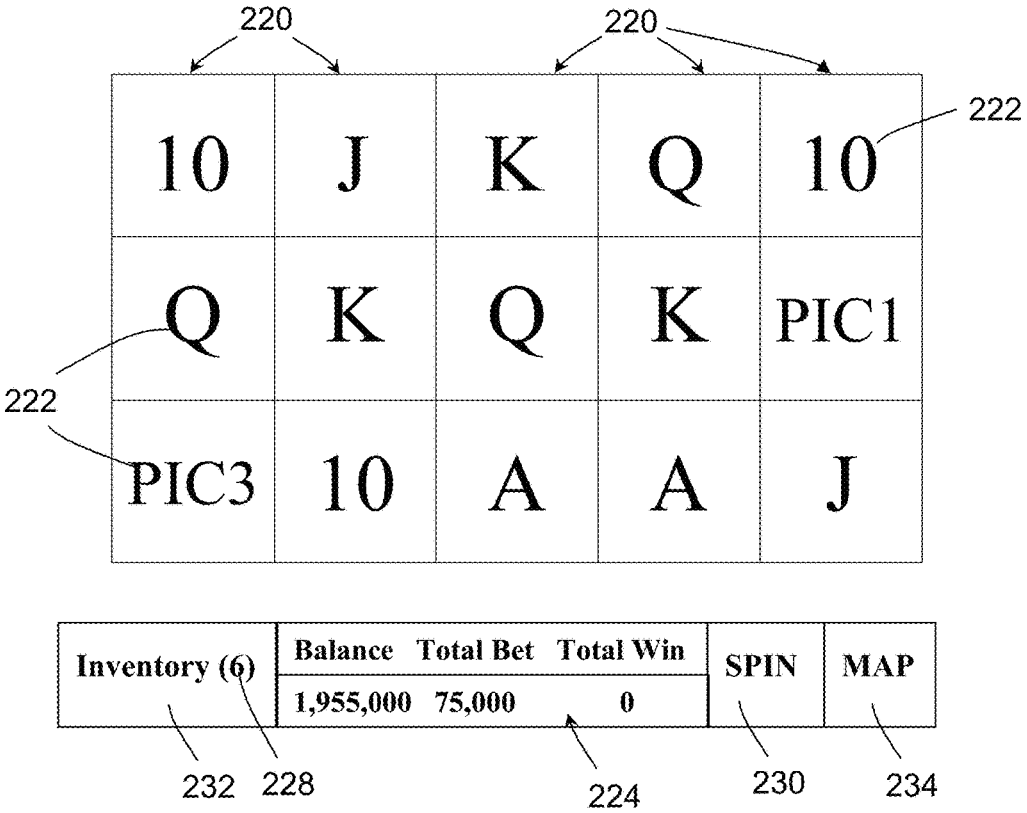
FIG. 8 is a diagrammatic representation of an exemplary base game screen that may be displayed to a player during implementation of a base game.

An exemplary screen that may be presented to a player during a base game is shown in FIG. 8.

Figure 20:
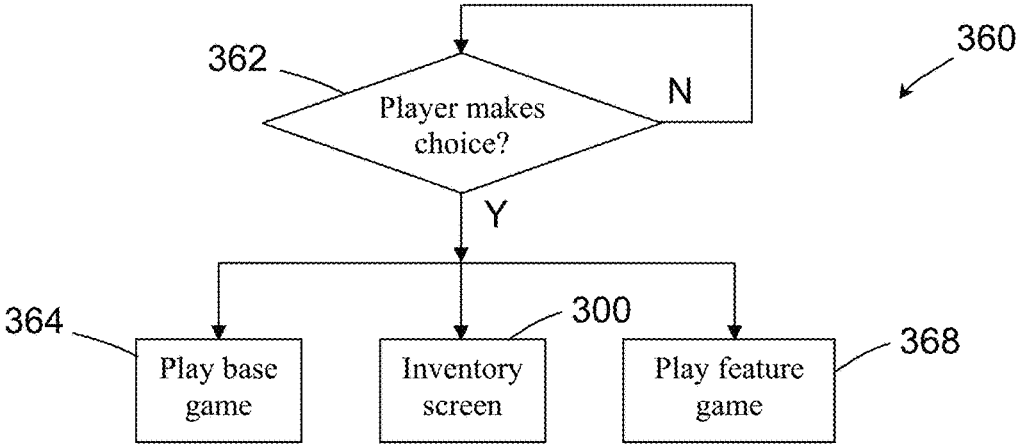
FIGS. 20 to 24 are flow diagrams illustrating an exemplary method of gaming.

As shown in the exemplary flow diagram 360 in FIG. 20, during game play, a player is provided with the option 362 of playing a base game 364 by activating a spin button 230, accessing an inventory screen 300 by activating an inventory button 232, or playing a feature game 368 by activating a map button 234. A player is able to commence a feature game by selecting the map button 234 at any time.

During implementation 364 of a base game, multiple reels 220 rotate and stop to display 3 symbols 222 on each reel 220. Win outcomes are determined on the basis of the symbols displayed.

Figure 21:
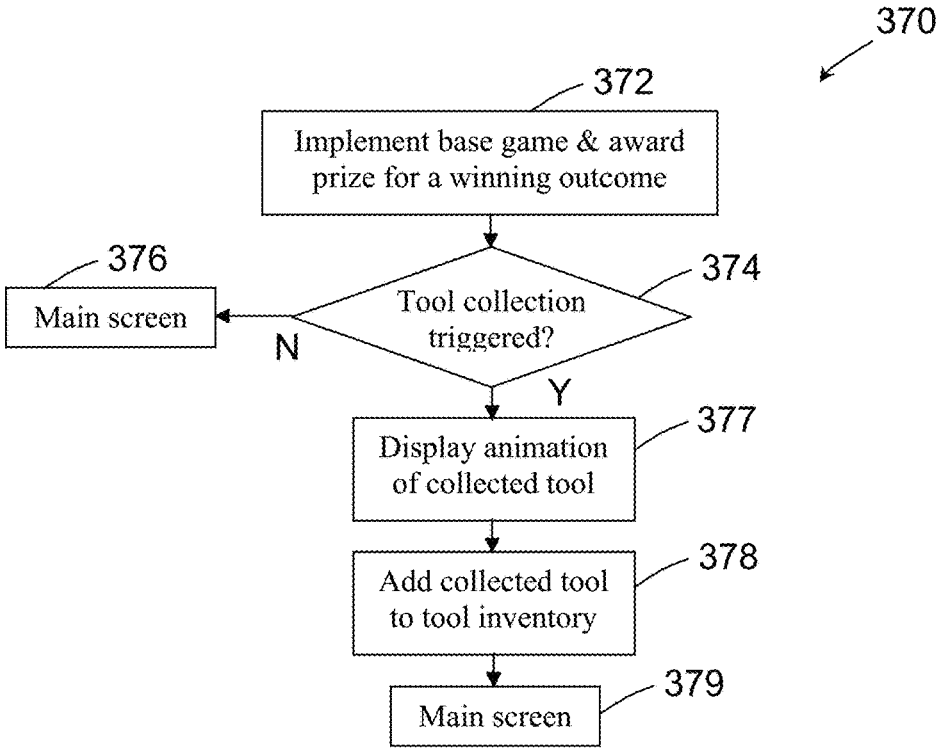

As shown in the exemplary flow diagram 370 in FIG. 21, during every base game an item collection process is triggered whereby one or more items may be added to an item inventory 18 associated with the player based on outcomes of the base game. In this example, the items are tools that are usable by an adventurer character in a feature game, and accordingly the items collected will be referred to as tools throughout the following example.

As an alternative to implementing a tool collection process as part of every base game, the tool collection process may be implemented after every base game, randomly and/or based on a defined trigger condition such as display of one or more defined symbols 222 during a base game.

As shown in FIG. 8, credit balance, bet and win information 224, and the number of tools 228 in the tool inventory 18 are also displayed to the player. Details about the collected tools in the tool inventory 18 associated with the player are displayed to the player by selecting the inventory button 232.

Figure 9:
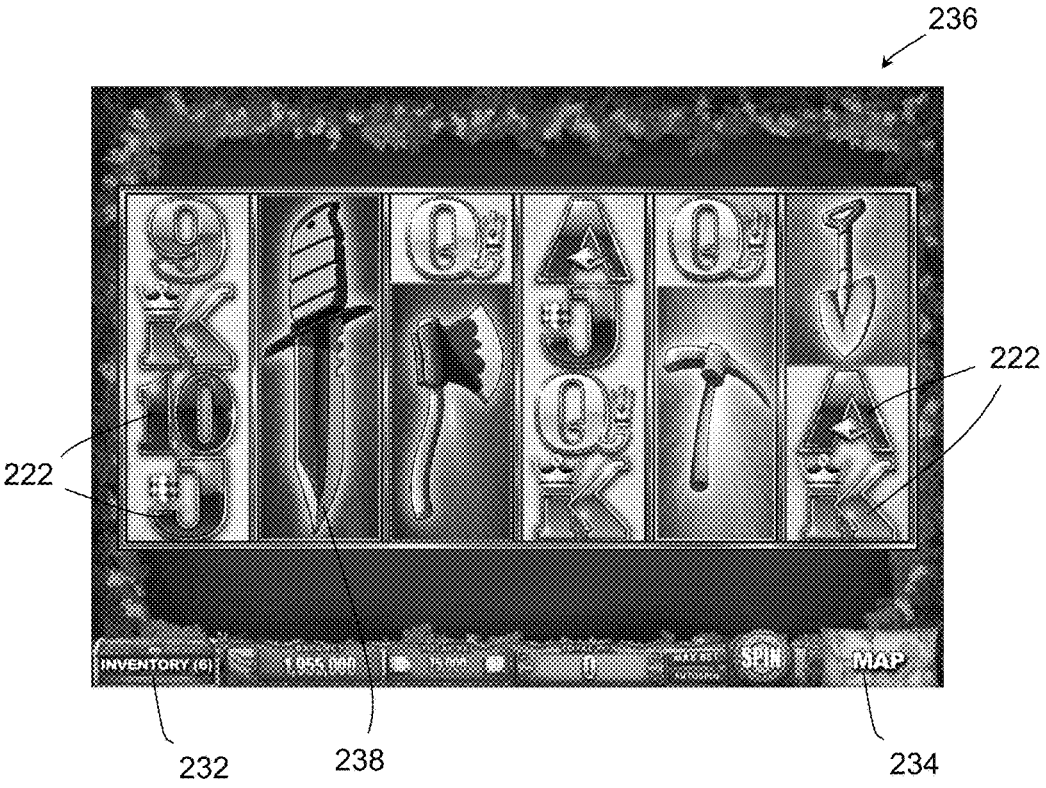
FIG. 9 is a diagrammatic representation of an exemplary tool collection screen that may be displayed to a player during tool collection.

An exemplary tool collection screen 236 presented to a player during an item collection process in a base game is shown in FIG. 9. Like and similar features are indicated with like reference numerals.

The reels 220 spin and when the reels stop spinning symbols 222 are shown on the reels.

In this example, if a complete tool is shown across a reel, the tool 238 is considered to have been collected and is added 378 to the tool inventory 18. For example, as shown in FIG. 9, 4 tools would be collected since 4 complete tools are shown in 4 reels.

It will be understood that since the knife tool spans across a greater area of a reel than other tools, the knife tool is less likely to be collected. Accordingly, it is possible to determine the collection probability by selecting the area of a reel covered by a tool.

Figure 10:
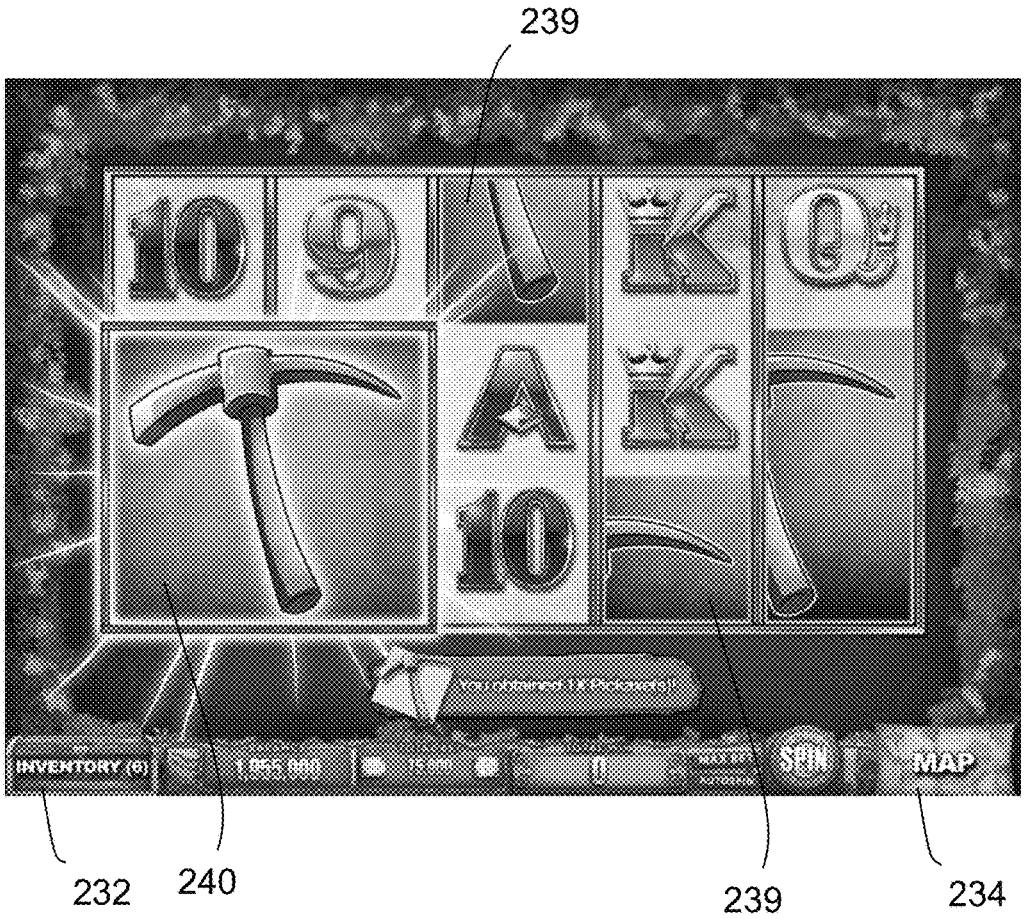
FIG. 10 is a diagrammatic representation of an alternative tool collection screen that may be displayed to a player during an alternative tool collection arrangement.

In an alternative tool collection process, as shown in FIG. 10, each collectible tool has 4 tool portions. If the 4 tool portions 239 align so as to define a tool, the tool 238 is considered to have been collected and is added 378 to the tool inventory 18. When the 4 displayed tool portions 239 align, the system may be arranged to animate 377 the displayed tool portions 239, for example by combining the displayed tool portions 239 into a single displayed tool 240, as shown in FIG. 10.

In addition to collecting tools during a base game, the base game may be arranged to award a prize based on the symbols displayed, for example with reference to defined pay tables. A displayed combination of symbols that corresponds to a prize may include a combination of tool portions displayed along a win line. For example, 3, 4 or 5 tool portions of a flint tool displayed on a defined win line may correspond to a winning outcome.

In an embodiment, a plurality of symbol sets may be provided, with each symbol set weighted towards at least one particular tool. As part of the tool collection process, the reel set to use in a base game may for example be randomly selected or selected based on defined rules. In an example, 5 reel sets are used with each reel having an equal chance of being selected for use in a base game.

After completion of the base game, the process returns the player to the screen shown in FIG. 8 which provides the player with the option 362 of playing a further base game 364 by activating the spin button 230, accessing an inventory screen 300, or playing a feature game 368.

The system may be arranged such that a completed tool is always displayed during a base game, or such that a completed tool occurs randomly. In the present embodiment, a weighted random selection process is used to determine which tool will appear.

However, it will be understood that other tool collection processes are envisaged. For example, in an alternative tool collection process the reels of the base game may be overlaid with a 'ghost' reel that includes a plurality of special symbols corresponding to the available tools. When a tool symbol on the ghost reel is displayed, or alternatively is displayed and coincides with a defined base game symbol, the tool is considered to be collected, and an animation may be displayed that shows the collected tool moving across the screen.

Figure 11:
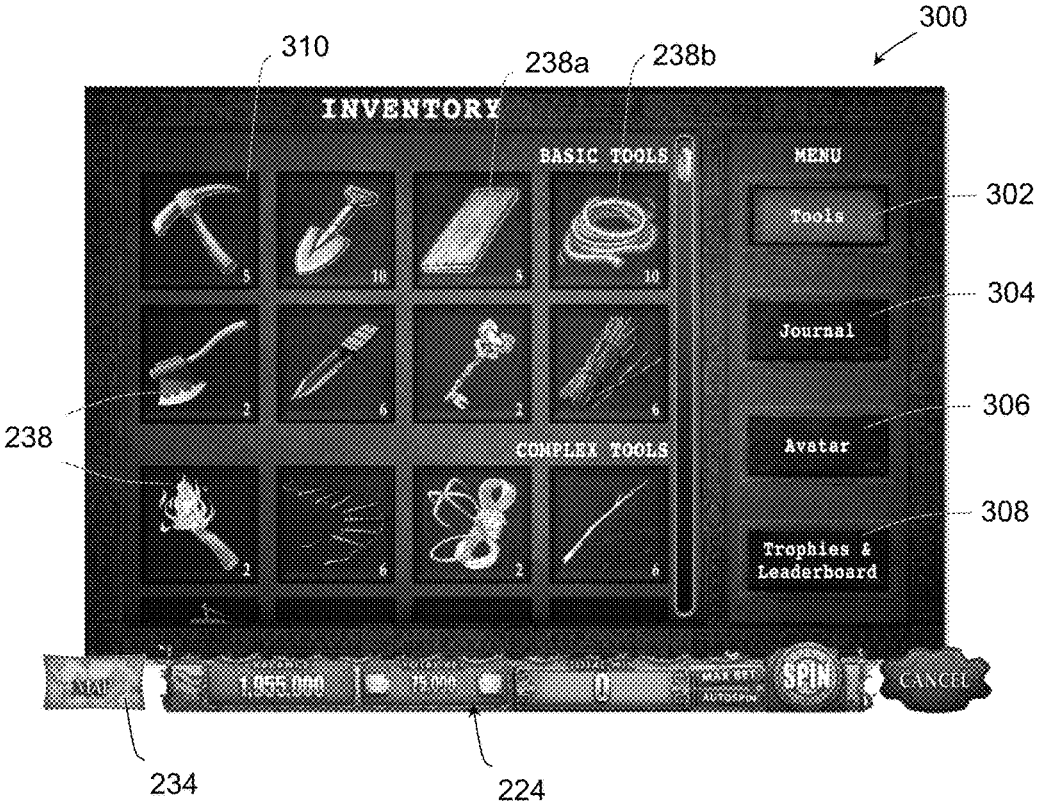
FIG. 11 is a diagrammatic representation of an exemplary tool inventory screen that may be displayed to a player to illustrate a tool inventory associated with the player.

When a player selects the inventory button 232, an exemplary inventory screen 300 is displayed, as shown in FIG. 11.

Figure 14:
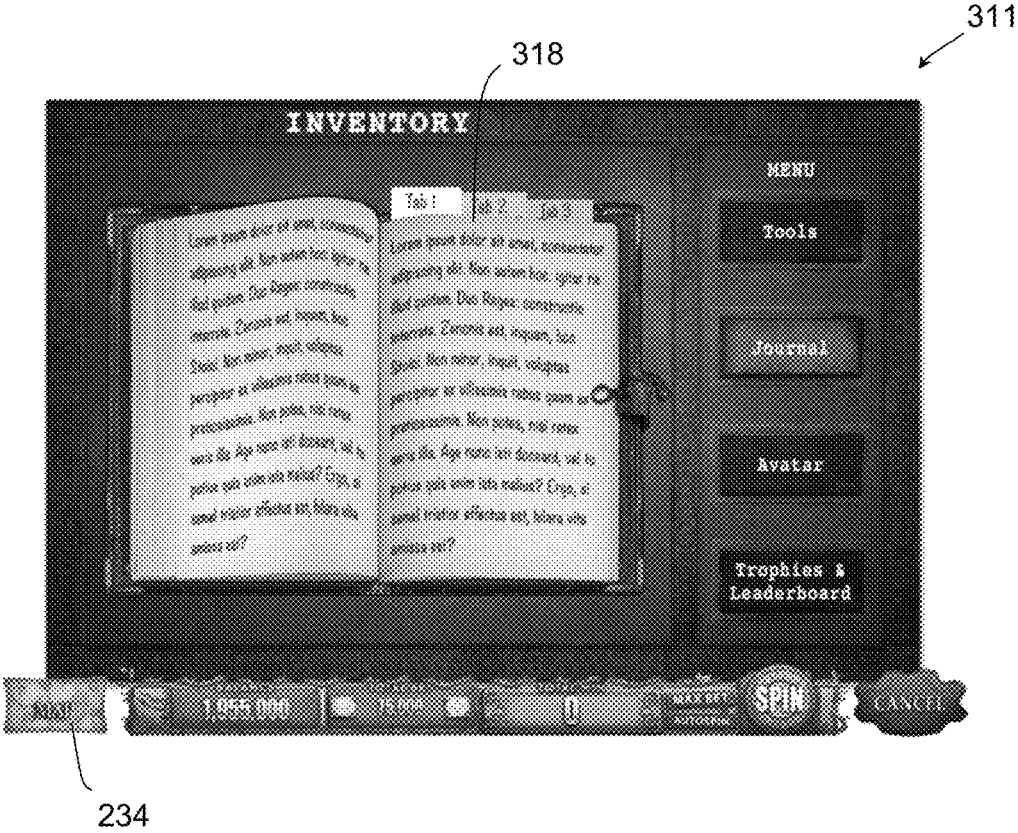
FIG. 14 is a diagrammatic representation of an exemplary journal screen.

The inventory screen 300 is used to access a tools section 310 by activating a tools button 302; to access a journal screen 311, as shown in FIG. 14, by activating a journal button 304; to access an avatar selection screen (not shown) by activating an avatar button 306; and to access a trophies and leaderboard screen (not shown) by activating a trophies button 308.

The tools section 310 includes tools 238 that have been collected and recorded in the tool inventory 18. Each tool 238 includes information indicative of the number of tools of that type that have been collected.

Using the inventory screen 300, a player associated with the tool inventory is able to combine tools together to create new tools.

Figure 22:
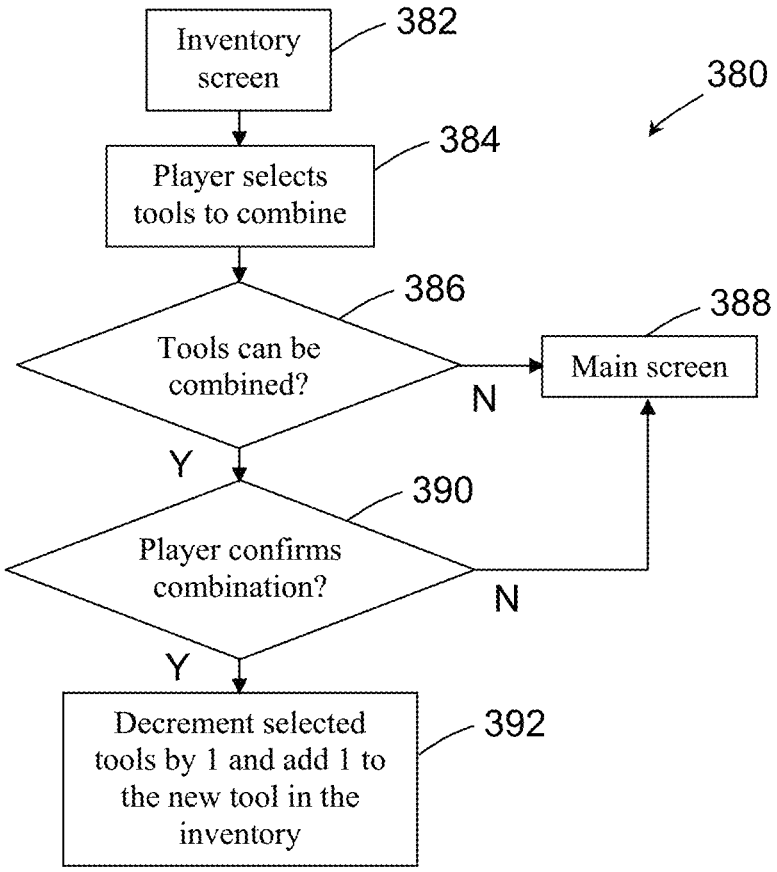

An exemplary process for combining tools to create new tools is shown in the flow diagram 380 in FIG. 22.

Using the inventory screen 300, the player combines tools 238, for example a plank of wood and rope, by dragging a plank tool 238*a* to a rope tool 238*b*. In this example, this action is effected by a player using the touchscreen of the smartphone.

As shown in FIG. 11, the tools 238 are displayed in different sections according to whether the tools are 'basic tools' of the type not formed by combining other tools, or 'complex tools' that are formed by combining other tools.

The tools 238 also include 'special tools' that are basic tools acquired during play of a feature game rather than a base game, and trophies that are special tools obtained during completion of an 'ultimate challenge' type feature game. A trophy signifies completion of an ultimate challenge and in this example a trophy is used to gain access to another ultimate challenge feature game.

Figure 12:
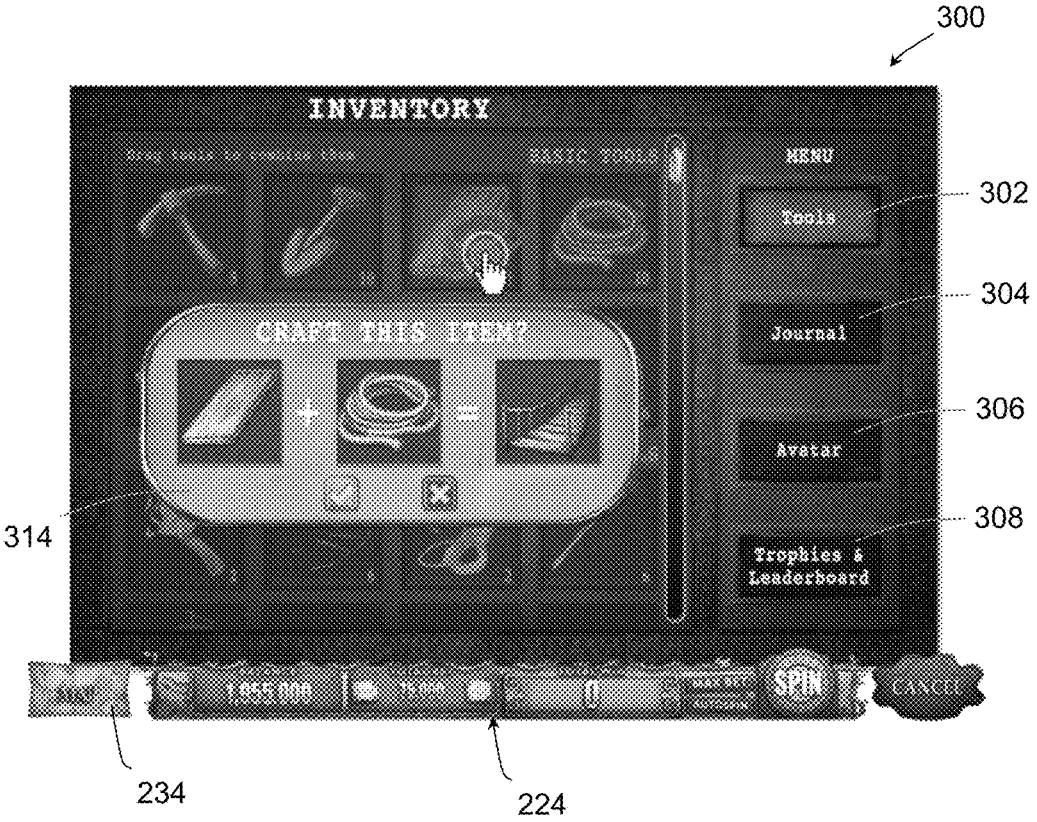
FIG. 12 is a diagrammatic representation of an exemplary new tool creation screen that may be displayed to a player.

If the selected tools are able to be combined 386, the system displays a confirmation message 314 and requests confirmation from the player 390 that the player wishes to combine the selected tools to create a new tool, as shown in FIG. 12. If the player confirms this, the tool numbers are adjusted 392, in this example by decrementing the number of plank and rope tools by 1, the credit amounts displayed for the wood planks and rope are decremented, and a new rope bridge tool is added to a complex tools section that has a credit value equal to the total combined value of the plank and rope tools.

Figure 13:
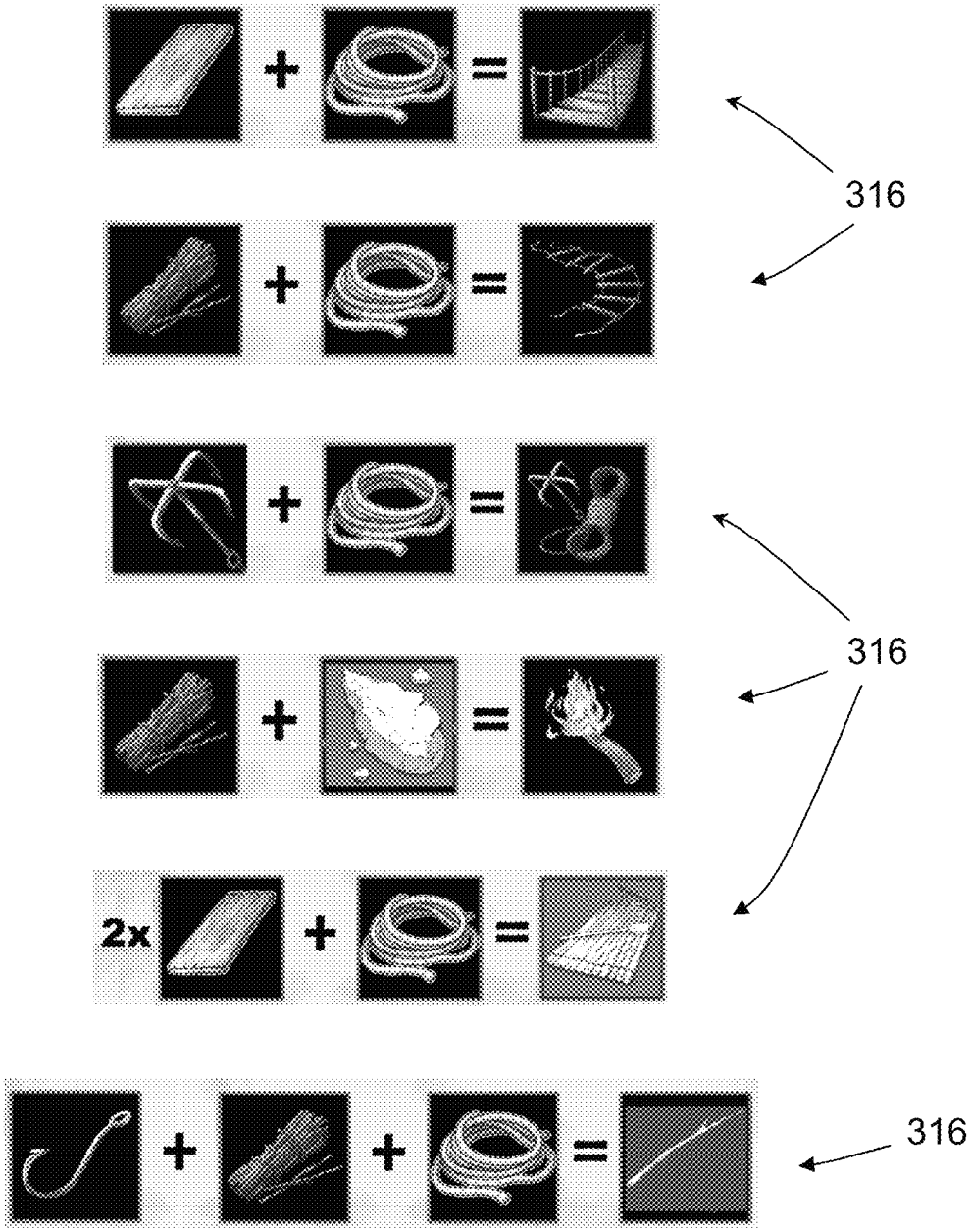
FIG. 13 is a diagrammatic representation showing exemplary new tool creation options.

Referring to FIG. 13, further examples 316 of tool combinations are shown. However, it will be understood that other combinations of 2, 3 or more tools are envisaged.

The inventory screen 300 may display tools that have not yet been collected by a player, for example by showing the tools that have not yet been collected in grey. In the present example, if such a tool is selected by a player, the system is arranged to prompt the player to combine the required tools in order to create a torch tool, in this example sticks and flint tools.

With this embodiment, if the player does not have sufficient tools in the tool inventory 18 to create a new tool, the system communicates to the player the tools that are required to create the new tool. For example, if the player selects a rope ladder tool, but the player does not have a rope ladder tool in the tool inventory 18, a message is displayed to the player to indicate the tools that are required in order to create a rope ladder tool, in this example a sticks tool and a rope tool.

It will be understood that for some feature games, the player will require one or more particular complex tools in order to complete the feature game, and consequently a level of strategic skill is required by the player in order to determine which tools may be required for a feature game, and/or which tools may be best suited to the feature game and thereby provide the highest likelihood of success or the best prize in the feature game.

A complex tool may also be converted back to basic tools, for example by a player dragging the complex tool from the complex tools section to the basic tools section.

In the present example, a tool in the inventory may be sold in order to convert the tool to a defined number of credits, for example by tapping on a selected tool 384 and selecting the number of tools that are desired to be sold.

After selecting the journal button 304, the player is presented with a representation of a journal 318, as shown in FIG. 14.

The journal 318 is used to provide game play information to the player including information about how to play the game, including how to create tools; to provide player hints in relation to game play; and to include notes, for example in relation to features that have been completed or partially completed, and information about the players progress in the feature games.

After selecting the trophies button 308, the player is presented with a trophies page (not shown).

In the present example, the feature theme is an adventurer theme grouped into sub-themes with each sub-theme including several feature games, and each sub-theme including an ultimate challenge feature game. Each ultimate challenge feature game is a multi-level game that requires multiple tools and some strategic skill to complete. On completion of the ultimate challenge feature, a special trophy unique to the sub-theme is awarded to the player. Other prizes, such as a credit value may also be awarded to the player.

Special tools awarded to the player are visible in the players trophy cabinet that is viewable by selecting the trophies button 308.

Unlike basic tools and complex tools, special trophy tools remain with the player when used to gain access to an ultimate challenge feature of another sub-theme. In this way, it is possible to manage complexity of the challenges and the player's progress through them.

After every ultimate challenge has been completed and all special trophy tools have been collected, the player's name appears in the game hall of fame that is viewable by selecting the trophies button 308. The hall of fame includes a list of players that have completed all ultimate challenges in a defined period of time.

In addition to obtaining tools through base game play, feature game play and by combining existing tools, the system may be arranged to enable a player to purchase tools, for example by enabling the player to select specific tools to be purchased, or by enabling the player to purchase tool packs that include a random selection of tools. The type and amount of tools included in such a tool pack may depend on the amount of credits spent by the player.

In the present example, the tool purchase may be implemented using the game controller application 32 implemented on the player's smartphone 44, for example by including a tool shop button (not shown) on the inventory screen 300.

After selecting the avatar button 306, the player is presented with an avatar selection screen (not shown) that enables the player to select characteristics of an avatar used in the feature games, for example whether the avatar is male or female, physical characteristics of the avatar, clothing worn by the avatar and so on.

In the present example, 3 different types of feature game are provided.

A first 'immediate return' feature game requires a player to use a selected tool in order to obtain a prize, typically in the form of credits, with the volatility involved being relatively low and therefore the probability of success relatively high.

A second 'tool generation' feature game requires a player to use a selected tool or tools in order to obtain a new basic tool. For example, in a feature game in a forest sub-theme, the player may select an axe tool to chop a tree trunk, and as a result the player obtains a random number of wood planks, or the player may select the axe tool to chop branches from the tree, and as a result the player obtains a random number of sticks. As an alternative, the player may select a knife tool to cut the tree trunk or branches, and while this may be successful, the probability is much lower than using the axe. Typically, multiple repeated attempts and broken knives will be required in order to successfully obtain wood planks or branches with a knife because a knife is less suitable than an axe for chopping wood.

A third 'ultimate challenge' feature game is a multi-stage feature game that requires a player to use several tools and apply a level of strategic puzzle solving skills to complete. In this example, each sub-theme has one ultimate challenge feature.

Figure 15:
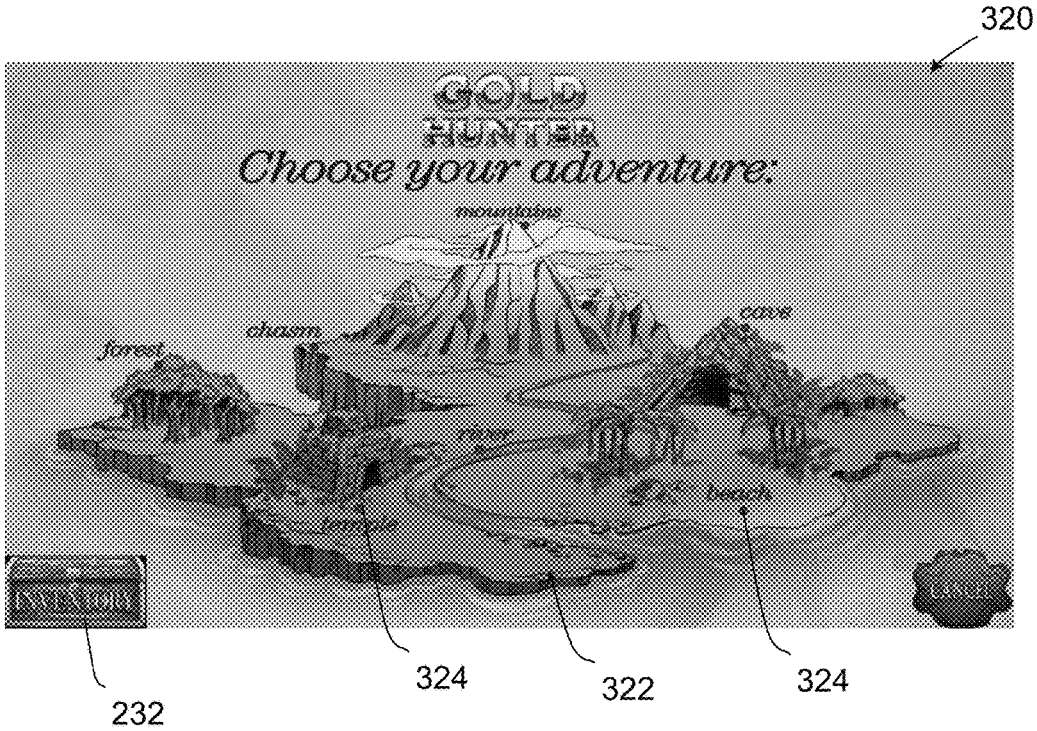
FIG. 15 is a diagrammatic representation of an exemplary map screen that may be displayed to a player to illustrate player selectable sub-themes.
Figure 16:
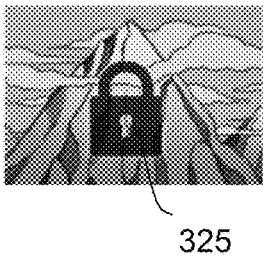
FIG. 16 is an exemplary representation of a locked sub-theme that may be displayed to a player.
Figure 23:
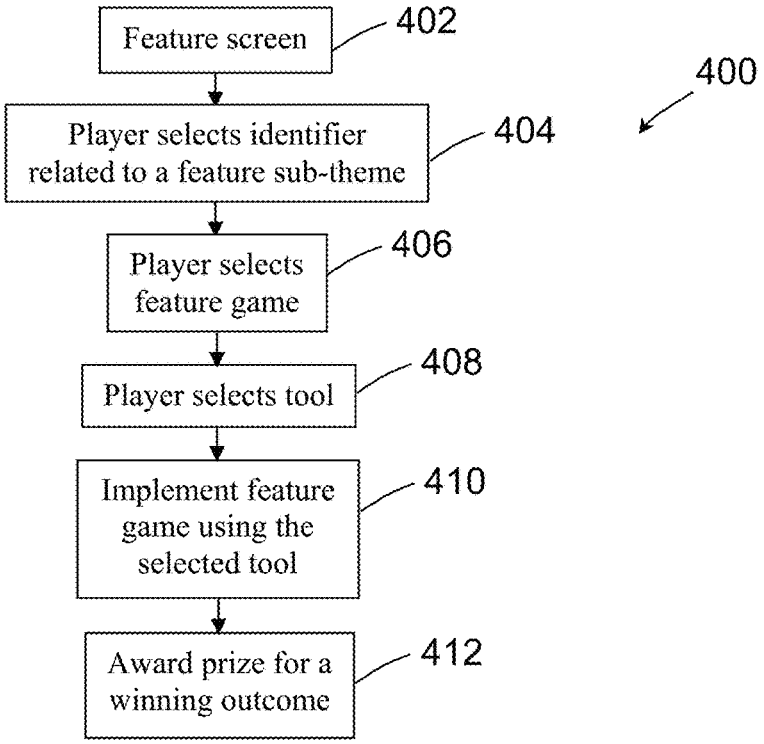

An exemplary feature game process 400 is shown in FIG. 23. When a player selects the map button 234, a map screen 320 is displayed, as shown in FIG. 15. The map screen 320 in this example shows a representation of a map 322 and identifiers 324 associated with respective available adventure sub-themes shown on the map 322. Identifiers 324 that are not selectable because they are currently locked are shown with a padlock 325, as shown in FIG. 16. If a player selects 404 one of the identifiers 324, a sub-theme screen 330 associated with the selected identifier 324 is displayed, as shown in FIG. 17.

In this example, each identifier 324 represents one or more feature games that are associated with a sub-theme within the general adventurer theme. For example, identifiers 324 may be shown on the map 322 adjacent different sub-theme locations, such as mountains, a chasm, a river, a cave, a beach, a temple and a forest, and each feature game associated with the identifier may relate to one or more tasks related to the selected sub-theme.

In the present example, the availability of sub-themes is controlled so that a player is provided with a natural progression through the sub-themes, for example by the availability of tools that are obtained through the base games and the opportunity to obtain basic tools in the feature games. For example, the system may be arranged such that the most common tools to be obtained in the base games are axe, knife and rope tools, and such that these tools can only be used on their own in specific sub-themes, in this example the forest, temple and river sub-themes. Accordingly, during initial game play, only the forest, temple and river sub-themes are likely to be available to the player. The forest sub-theme is also the only sub-theme that has an ultimate challenge that can be played without the need for a special trophy tool to gain access to the ultimate challenge.

Figure 17:
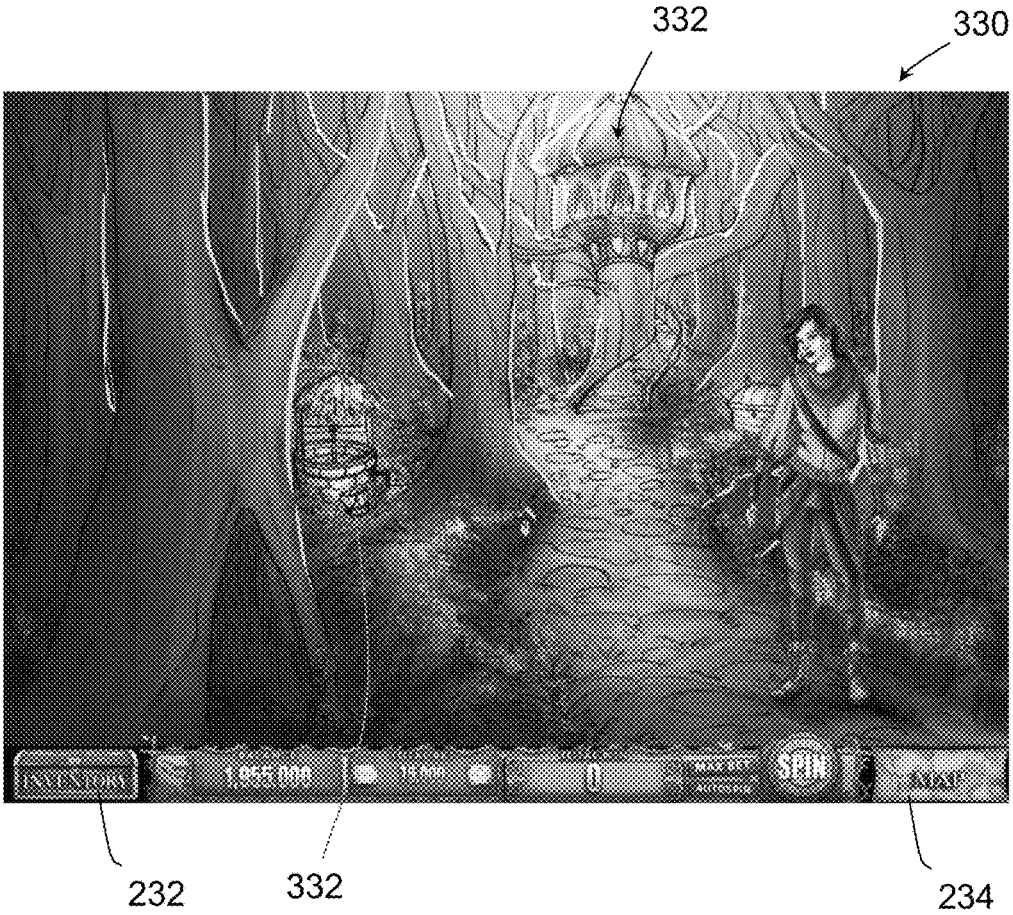
FIG. 17 is a diagrammatic representation of an exemplary sub-theme screen that may be displayed to a player to illustrate player selectable feature games.

The example sub-theme screen 330 shown in FIG. 17 includes a representation of a scene, in this example a forest, with game icons 332 that represent individual feature games displayed on the scene, in the present example a hollow tree feature, a well feature, a treasure chest feature, a woods feature and a treehouse ultimate challenge feature. When a player selects 406 one of the game icons 332, a feature game associated with the game icon commences.

In this example, if the tool inventory 18 associated with the player has at least one tool required for at least one feature game, then the game icon 332 associated with the feature game is selectable; if the tool inventory 18 associated with the player does not have at least one tool required for at least one feature game, then the game icon 332 associated with the feature game is shown in grey and is not selectable.

Figure 18:
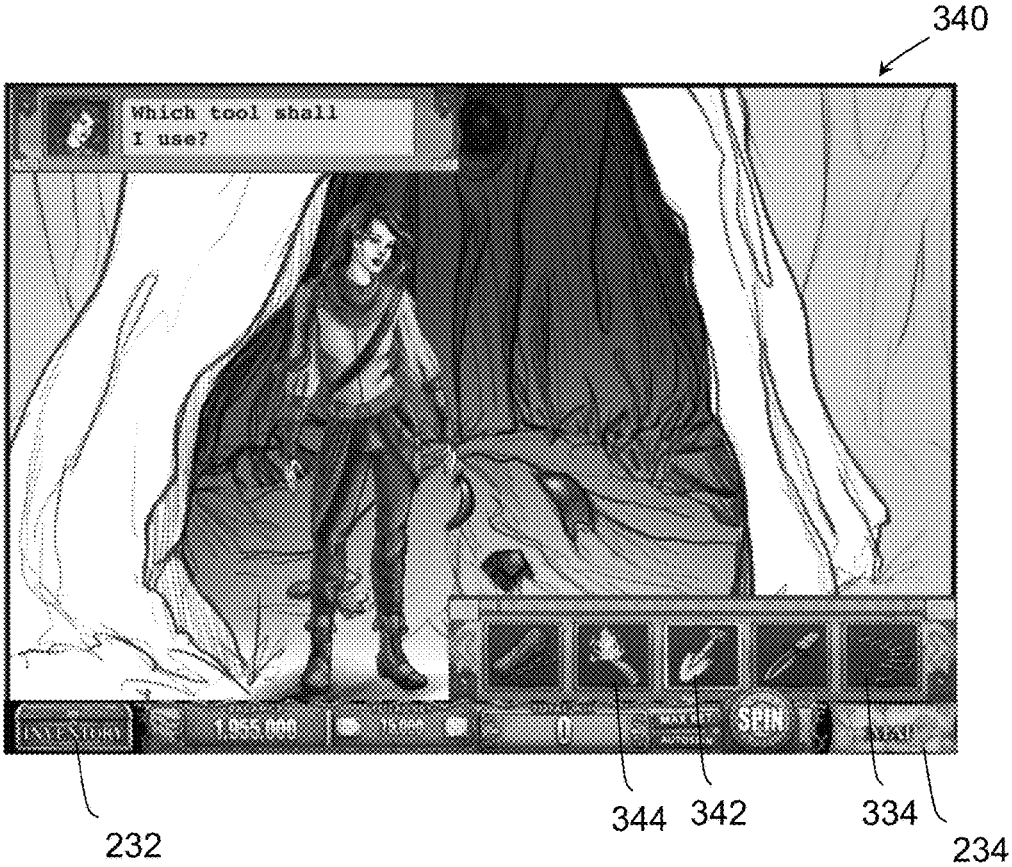
FIG. 18 is a diagrammatic representation of an exemplary feature game screen that may be displayed to a player after selection of a feature game.

After selection of an available feature game, for example a feature game related to a hollow tree, a feature game screen 340 is displayed as shown in FIG. 18, and the available tool option(s) 334 for use in the feature game are displayed to the player. In response, the player selects 408 one of the tools. Each tool option 334 may be related to a different action in the feature game and may have a different associated probability of success and/or a respective different prize amount.

In an embodiment, any tool in the inventory may be selected 384 irrespective of whether the tool is appropriate for completion of the task. With this arrangement, if a tool is selected that is inappropriate for completion of the task, the probability of success will be zero. Similarly, the system may be arranged such that that player has the option of selecting no tools from the inventory, and if this occurs the probability of success will be zero.

In the present example, the player selects a shovel tool 342 and in response the avatar commences digging inside the hollow tree. In this example, the success rate is 100% but the type of item found by digging varies randomly, and may include coins, gemstones and so on. However, if a torch tool 344 is selected, the hollow tree becomes illuminated to the extent that a hidden item becomes visible in a nook of the tree. Touching the item causes it to be revealed as treasure. If the player applies the shovel tool 342 after applying the torch tool 344, the probability of obtaining a higher prize will increase because the avatar is able to see more clearly and better decide where to dig.

Accordingly, it will be understood that during feature play the type of prize awarded and the probability of success depends on the types of tool selected and the degree of strategic puzzle solving skills applied by the player.

The probability of success and the amount of credits that can be won may be determined according to how difficult the task represented in in the feature game is considered to be.

Alternatively, the average prize awarded may be equal to the combined value of the tools used for the task.

After the player has selected the tool option to use, the system determines the outcome by using the tool, and an animation sequence is retrieved from the feature game animations 20 in the memory 42 and displayed to the player. The animation will be selected based on the determined outcome.

After selection and use of tools, the tool inventory 18 is decremented according to the tools used, and the appropriate credit amount, if any, is added 412 to the credit meter and therefore displayed as part of the credit information 224.

Figure 19:
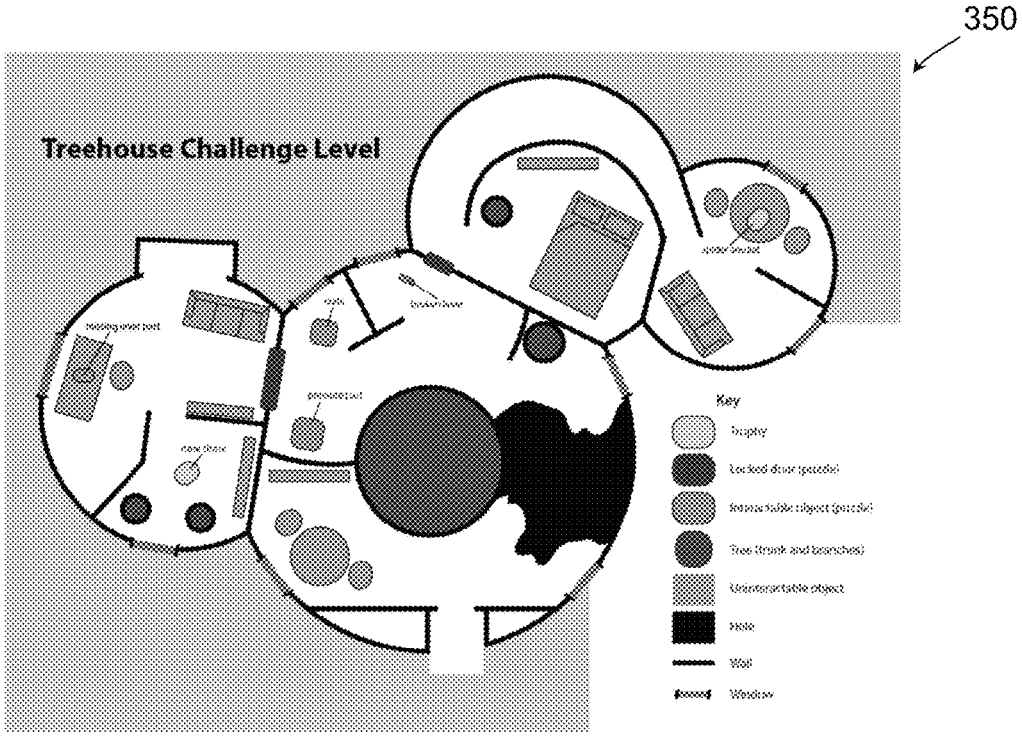
FIG. 19 is a diagrammatic representation of an exemplary map representation that may be displayed to a player after selection of a challenge feature game.

If the player selects the treehouse ultimate challenge feature from the sub-theme screen 330 shown in FIG. 17, the player enters the treehouse ultimate challenge and a treehouse ultimate feature screen (not shown) is displayed. In order to complete the treehouse ultimate challenge feature, the player is required to complete multiple levels using tools, and in order to do this the player may be required to obtain tools from other feature games, in addition to basic tools that the player has obtained from base game play. A map representation 350 of one level of the treehouse ultimate challenge feature is shown in FIG. 19, the map representation 350 showing puzzle type features, features that involve interaction with an object, and the location of a special trophy tool.

In a variation, the system may be arranged such that the feature game and/or aspects of the feature game are modified according to defined circumstances, for example based on the time of year. In an example, a Christmas themed feature game may be available only during December/January, or for example a Halloween themed tool is only available during October.

In an alternative embodiment, the gaming system is implemented in the form of an electronic gaming machine.

With this embodiment, in order to ensure that a player strategy cannot be employed that affects the return to player, the player will be instructed by the system to sell or play the tools in the player's tool inventory 18 if the player has selected a different bet multiplier. In this way, the bet structure for the feature games will be the same.

Figure 24:
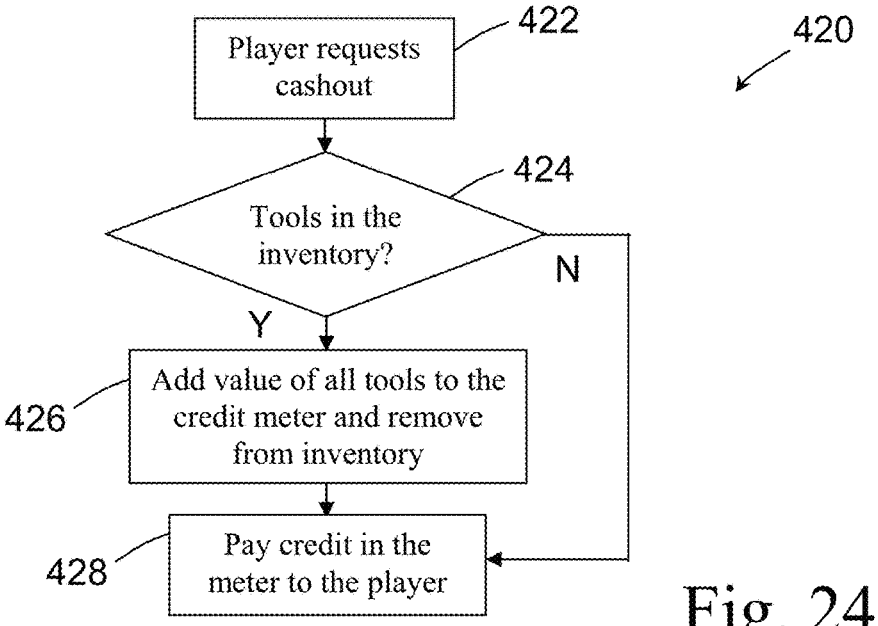

An exemplary cashout process for an electronic gaming machine implementation is illustrated in the flow diagram 420 in FIG. 24.

If a player opts to collect the credits in the credit meter 422, the system checks 424 whether any collected tools are present in the tool inventory 18 and if any tools are present the combined credit value of the tools in the tool inventory 18 is added 426 to the credit meter, and the tools are removed from the tool inventory 18. The total credit in the credit meter is then paid 428 to the player.

The system may be arranged such that multiple implementations are provided such as an implementation on a computing device such as a smartphone and an implementation on an electronic gaming machine, with the system arranged such that tools obtained during one of the implementations are also available at the other implementation, and/or such that feature games may commence on one of the implementations and continue on the other implementations. For example, tools obtained using an implementation on a smartphone or on a social media app implementation may be transferrable to an implementation on an electronic gaming machine, and vice versa. This may be facilitated in any suitable way, for example by displaying a machine readable identifier, such as a QR code, on a gaming machine at cash out so that the player can scan the QR code, for example using the player's smartphone. By providing the QR code with associated information about the state of the feature games, tools available in the player's inventory and so on, it is possible to link the players progress in the feature games on the electronic gaming machine to the players progress on the players smartphone and for example store relevant information about the player's progress in the relevant player record 48 at the server 47.

In an alternative embodiment, the gaming system may be implemented as part of a social media application, for example as an app in Facebook®.

In the claims of this application and in the description of the invention, except where the context requires otherwise due to express language or necessary implication, the words "comprise" or variations such as "comprises" or "comprising" are used in an inclusive sense, i.e. to specify the presence of the stated features but not to preclude the presence or addition of further features in various embodiments of the invention.

Modifications and variations as would be apparent to a skilled addressee are deemed to be within the scope of the present invention.

What is claimed is:

1. A gaming system comprising:

a processor configured to execute instructions stored on a memory, which when executed, cause the processor to at least:

selectively add, during play of a base game, at least one item from a plurality of available items to an item inventory of collected items associated with a player, wherein each collected item is usable by the player in a feature game, and wherein the at least one item is at least partially displayed on at least one reel of a plurality of reels;

store the item inventory of collected items usable by the player in the feature game;

receive a selection, by the player and via a user interface, of at least one collected item from the item inventory of collected items to use in the feature game, wherein the processor is further configured to prevent play of the feature game if the at least one collected item selected from the item inventory of collected items is unsuitable for use in performing a task; and determine an outcome of the feature game based on the at least one collected item selected from the item inventory of collected items, wherein the feature game is initiated by the player at any time.

2. The gaming system in accordance with claim 1 wherein the instructions when executed further cause the processor to determine an outcome of the feature game based on one of the task being successfully completed using the at least one collected item selected from the item inventory of collected items or a random determination.

3. The gaming system in accordance with claim 2 wherein a probability of the task being successfully completed is at least partially dependent on the suitability of the at least one collected item selected from the item inventory of collected items in performing the task.

4. The gaming system in accordance with claim 2 wherein the instructions when executed further cause the processor to award a prize when the outcome is a successful outcome, in which the at least one item selected from the item inventory of collected items is at least partially successful in completing the task.

5. The gaming system in accordance with claim 2 wherein the item inventory of collected items is at least one of transferable to another player or retainable by the player for use in subsequent game play.

6. The gaming system in accordance with claim 2, wherein items collected by the player in a first gaming system implementation are selectively transferrable and usable in a different second gaming system implementation.

7. A method of electronic gaming comprising:

displaying, by a processor of an electronic gaming machine and on a display device of the electronic gaming machine, a plurality of reels, the plurality of reels displayed in conjunction with a base game;

selectively adding, by the processor and during play of the base game, at least one item from a plurality of available items to an item inventory of collected items associated with a player, wherein each collected item is usable by the player in a feature game, and wherein the at least one item is at least partially displayed on at least one reel of the plurality of reels;

receiving, by the processor and via a user interface, a player selection of at least one collected item from the item inventory of collected items to use in the feature game, wherein the processor is further configured to prevent play of the feature game if the at least one collected item selected from the item inventory of collected items is unsuitable for use in performing a task; and determining, by the processor, an outcome of the feature game based on the at least one collected item selected from the item inventory of collected items, wherein the feature game is initiated by the player at any time.

8. The method in accordance with claim 7 wherein determining, by the processor, an outcome of the feature game further comprises determining an outcome of the feature game based on one of the task being successfully completed by the player in the feature game using the at least one collected item selected from the item inventory of collected items or a random determination.

9. The method in accordance with claim 7 wherein determining, by the processor, an outcome of the feature game further comprises determining an outcome of the feature game based at least partially on the suitability of the at least one collected item selected from the item inventor of collected items in performing the task.

10. The method in accordance with claim 7 further comprising awarding, by the processor, a prize to the player when the outcome is a successful outcome, in which the at least one item selected from the item inventory of collected items is at least partially successful in completing the task.

11. The method in accordance with claim 7 wherein the item inventory is at least one of transferable to another player or retainable by the player for use in subsequent game play.

12. The method in accordance with claim 7 wherein items selected by the player in a first gaming system implementation are selectively transferrable and usable in a different second gaming system implementation.

13. A gaming system comprising:

a display device; and a processor communicatively coupled to the display device and configured to execute instructions stored in a memory, which when executed by the processor, cause the processor to at least:

display, on the display device, a plurality of reels, the plurality of reels displayed in conjunction with a base game;

display, on the display device, a user interface, the user interface including:

an item collector configured to enable a player to select and store, during play of the base game, at least one item from a plurality of available items in an item inventory of collected items, the at least one item at least partially displayed on at least one reel of the plurality of reels, and, an item selector configured to enable the player to select at least one collected item from the item inventory of collected items for use in a feature game, wherein the processor is further configured to prevent play of the feature game if the at least one collected item selected from the item inventory of collected items is unsuitable for use in performing a task; and determine an outcome of the feature game based on the at least one collected item selected from the item inventory of collected items, and a use of the at least one collected item selected from the item inventory of collected items in the feature game.

14. The gaming system in accordance with claim 13 wherein the instructions when executed further cause the processor to implement the feature game at any time, based on input from the player.

15. The gaming system in accordance with claim 13 wherein the instructions when executed further cause the processor to determine the outcome based at least partially on one of a random determination or the task being successfully completed in the feature game using the collected item selected from the item inventory of collected items.

16. The gaming system in accordance with claim 13 wherein the item inventory of collected items is at least one of retainable by the player for use in subsequent game play or transferrable to another player.

17. The gaming system in accordance with claim 13 wherein the instructions when executed by the processor further cause the processor to award a prize when the outcome is a successful outcome, wherein the prize awarded is at least partially based on the collected item selected for use in the feature game.

* * * * *